US005458074A

United States Patent [19]

Kojima et al.

[11] Patent Number: 5,458,074

[45] Date of Patent: Oct. 17, 1995

[54] SEWING DEVICE

[75] Inventors: Horoshi Kojima, Utsunomiya; Nobuo Baba, Kaminokawa, both of Japan

[73] Assignee: The Singer Company N.V., Curacao, Netherlands Antilles

[21] Appl. No.: 308,529

[22] Filed: Sep. 19, 1994

[51] Int. Cl.[6] ..... D05B 19/00

[52] U.S. Cl. ..... 112/470.03; 112/155; 112/304

[58] Field of Search ..... 112/121.11, 155, 112/320, 304, 260, 316, 317, 318, 322, 141, 121.15

[56] References Cited

U.S. PATENT DOCUMENTS

| | | | |
|---|---|---|---|
| 3,468,273 | 9/1969 | Lester | 112/155 X |
| 4,432,295 | 2/1984 | Raisin et al. | 112/155 X |
| 4,856,442 | 8/1989 | Brocklehurst | 112/304 X |

*Primary Examiner*—Peter Nerbun
*Attorney, Agent, or Firm*—McCormick, Paulding & Huber

[57] ABSTRACT

A sewing device comprises endless conveyer belts for feeding a sewn product on a feeding surface, a feeding drive unit, a sewn product supporting member which is provided under the endless conveyer belts on the feeding side of the sewn product and a cloth end detecting means which is provided between the needle position line of a pair of sewing machines and the sewn product supporting member for detecting either of the front end portion or the rear end portion of a preceding sewn product when a given interval is formed between the preceding sewn product which has been fed by the endless conveyer belts and a following sewn product which is placed on the sewn product supporting member, wherein the feeding drive unit starts operation upon completion of lifting of the sewn product supporting member which carries the following sewn product thereon and stops operation when the cloth end detecting means detects either of the front end portion or the rear end portion of the preceding sewn product. As a result, it is possible to constantly keep a proper interval between the preceding sewn product and the following sewn product which is placed on the sewn product supporting member so as to rationalize the cut-off operation of continuously sewn products.

2 Claims, 7 Drawing Sheets

SEWING DEVICE

BACKGROUND OF THE INVENTION

1. Field of the Invention

The present invention relates to a sewing device for sewing a cloth to be sewn (referred to as a sewn product hereinafter) at both sides thereof concurrently.

2. Prior Art

In case of sewing a mask cloth A made of gauze as illustrated in FIG. 10, conventionally the folded mask cloth A is sewn by a sewing machine alternately along a line apart from each side thereof by a given distance ML to form a stitch line FT in each side portion thereof. Moreover, back tack stitches BT are formed at the start and end of sewing to prevent the stitch lines FT from coming loose.

As described above, a conventional mask sewing device employs a normal sewing machine for alternately sewing each side thereof. As a result, efficiently sewing a mask of high quality which has uniform stitch lines symmetrical to each other on both sides thereof requires a skilled operation, causing a bottleneck in rationalizing the sewing processes in a sewing factory.

Moreover, generally in a sewing factory, sewn products each having a given dimension such as mask cloths are sewn one after another by a continuously operating sewing machine and thereafter an operator cuts off the portions of the needle and bobbin threads which connect the sewn products to one another.

When an operator cuts off the connecting portions, the length of the connecting portions is desirable to be on the order of several millimeters in order to cut off the same in one cutting operation. When the connecting portions are too long, additional operation is needed to cut off again the connecting portions remaining to the mask cloths, and when they are too short, the mask cloths are liable to be damaged by mistake in cutting.

SUMMARY OF THE INVENTION

The present invention has been made in view of such a technical problem of the prior art. A first aspect of the invention is a sewing device comprising a pair of sewing machines 1 and 1 which are fixed on a working table 2 left and right thereon to confront each other and are operated synchronously, endless conveyer belts 6 which are provided above the feeding surface 19*a* of the working table 2 for feeding forward and backward a sewn product M on the feeding surface 19*a* from the feeding side X to the sending-out side Y thereof, a feeding drive unit 5 for driving the conveyer belts 6 normally and reversely, a sewn product supporting member 9 which is disposed under the conveyer belts 6 at the feeding side X of the sewn product M for placing the same thereon, a vertically driving unit 7 for driving the sewn product supporting member 9 up and down between the height of the feeding surface 19*a* and below the feeding surface 19*a* and a cloth end detecting means S2 which is provided between the needle position line NB of the sewing machines 1 and 1 and the sewn product supporting member 9 for detecting either of a front end portion AF or a rear end portion AR of a preceding sewn product M when a given interval N' is formed between the sewn product M fed by the conveyer belts 6 and the following sewn product M placed on the sewn product supporting member 9, wherein the feeding drive unit 5 starts operation upon completion of lifting of the sewn product supporting member 9 which carries the sewn product M thereon and stops operation when the cloth end detecting means S2 detects either of the front end portion AF or the rear end portion AR of the sewn product M.

A second aspect of the invention is a sewing device according to the first aspect thereof characterized in comprising a cloth position detecting means S1 which is provided between the needle position line NB of the sewing machines 1 and 1 and the cloth end detecting means S2 apart from the needle position line NB by a given distance N for activating the feeding drive unit 5 to feed a first sewn product M1 toward the sending-out side Y as far as the given distance N when the front end portion AF of the first sewn product M1 is detected and then driving the sewing machines 1 and 1 and the feeding drive unit 5 to form back tack stitches BT adjacent to the front end portion AF of the first sewn product M1.

A third aspect of the invention is a sewing device according to the second aspect thereof characterized in that the cloth position detecting means S1 activates the feeding drive unit 5 to feed the preceding first sewn product M1 toward the sending-out side Y by the difference C between the given distance N and the given interval N' and the sewing machines 1 and 1 are driven as well when the cloth position detecting means S1 detects the front end portion AF of the following sewn product M2, then issues a control signal for driving the sewing machines 1 and 1 and feeding drive unit 5 to form back tack stitches BT adjacent to the rear end portion AR of the preceding first sewn product M1.

According to the first aspect of the invention, a sewn product M is placed on the sewn product supporting member 9 which has been lowered, and the vertically driving unit 7 lifts the sewn product supporting member 9 to the height of the feeding surface 19*a*. Upon completion of lifting of the sewn product supporting member 9 which carries the sewn product M thereon, the feeding drive unit 5 starts operation to drive the conveyer belts 6 normally thereby to feed the sewn product M on the feeding surface 19*a* from the feeding side X to the sending-out side Y. The sewn product supporting member 9 is lowered by the vertically driving unit 7 to carry the next sewn product M thereon.

When a given interval N' is formed between the sewn product M and the following sewn product M on the sewn product supporting member 9, the cloth end detecting means S2 detects either of the front end portion AF or rear end portion AR of the preceding sewn product M, so that the feeding drive unit 5 stops operation based on the detection signal. Then the vertically driving unit 7 lifts the sewn product supporting member 9 which carries next sewn product M thereon to the height of the feeding surface 19*a* and the feeding drive unit 5 drives the conveyer belts 6 normally to feed the sewn product M on the feeding surface 19*a* from the feeding side X to the sending-out side Y. In this way, given intervals N' are formed in succession between adjacent sewn products M while the pair of sewing machines 1 and 1 sew the both side portions of the sewn products M one after another when the same reach the needle position line NB.

According to the second aspect of the invention, a first sewn product M1 on the sewn product supporting member 9 is fed by the conveyer belts 6 from the feeding side X to the sending-out side Y, and when the cloth position detecting means S1 detects the front end portion AF of the sewn product M1, it activates the feeding drive unit 5 to feed the sewn product M1 toward the sending-out side Y as far as the given distance N. As a result, the front end portion AF of the first sewn product M1 reaches the needle position line NB. Thereafter back tack stitches BT can be formed adjacent to the front end portion AF of the sewn product M1 by driving the sewing machines 1 and 1 and feeding drive unit 5.

According to the third aspect of the invention, the cloth position detecting means S1 activates the feeding drive unit 5 to feed the first sewn product M1 toward the sending-out side Y by the difference C between the given distance N and the given interval N' and drives the sewing machines 1 and 1 as well when the cloth position detecting means S1 detects the front end portion AF of the succeeding sewn product M2 while the sewn product M is fed by the conveyer belts 6 from the feeding side X toward the sending-out side Y, so that the preceding sewn product M1 is subjected to sewing until the rear end portion AR thereof reaches the needle position line NB. Thereafter back tack stitches BT can be formed adjacent to the rear end portion AR of the preceding sewn product M1 by driving the sewing machines 1 and 1 and feeding drive unit 5.

PREFERRED EMBODIMENT OF THE INVENTION

An embodiment of the present invention will be described hereinafter with reference to drawings.

FIG. 1 to 10 show the embodiment. In FIGS. 1 to 4, denoted at 1 and 1 are sewing machines, which are fixed on a working table 2 left and right thereon apart by a given interval to confront each other. The sewing machines 1 and 1 are driven synchronously by a sewing machine motor 3 provided under the working table 2 by way of timing belts, now shown. It is possible to sew the both side portions of the mask cloth M concurrently by the pair of sewing machines 1 and 1.

Figure 10:
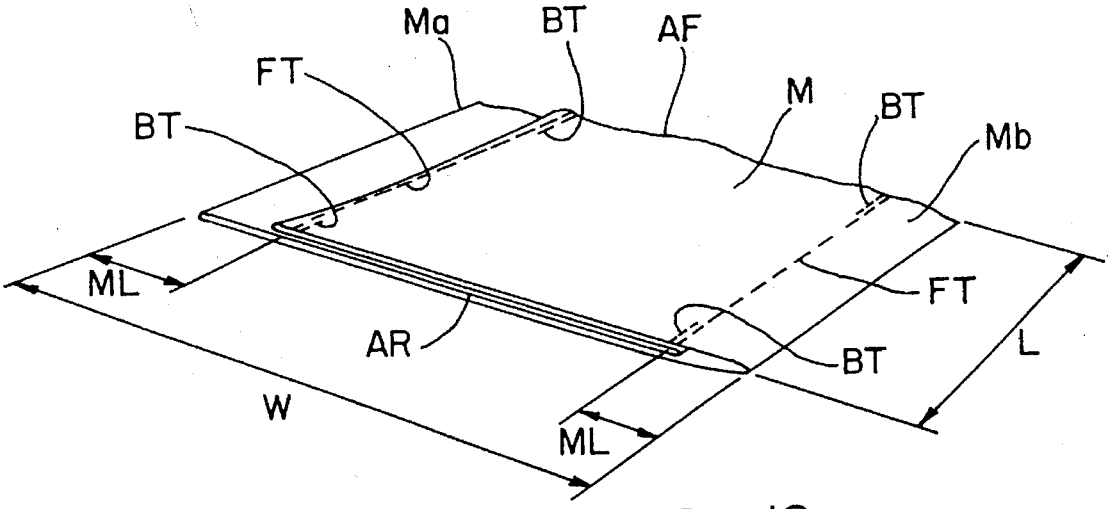
FIG. 10 is a perspective view of a mask cloth in FIG. 1.

The mask cloth M is made of gauze and has a rectangular shape having a width W and a length L with folded end portions Ma and Mb formed at both widthwise end portions thereof in the direction of the width W as illustrated in FIG. 10. Such a mask cloth M is subjected to sewing in the folded end portions Ma and Mb thereof at the positions apart from the end portions by a given distance ML to form stitch lines FT which stitch the folded end portions Ma and Mb together respectively and form back tack stitches BT adjacent to the front end portions AF and rear end portions AR of the stitch lines FT at the start and end of sewing to prevent the stitch lines FT from coming loose.

Figure 3:
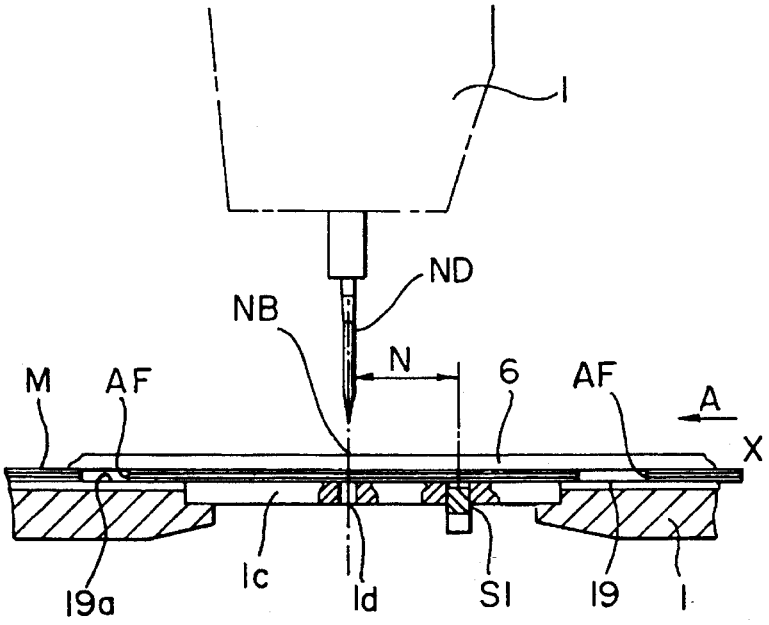
FIG. 3 is a side view of the sewing device showing a portion about a throat plate thereof in cross section in FIG. 1.
Figure 4:
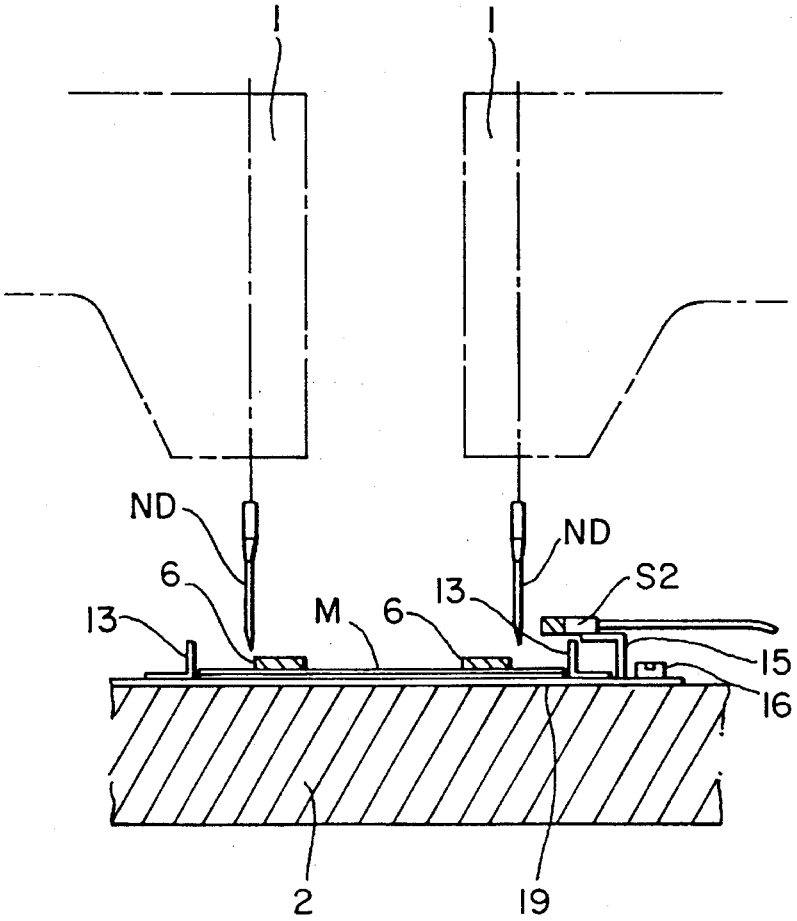
FIG. 4 is a front view of the sewing device showing the mounting state of a cloth end sensor in FIG. 1.

Guide members 13 and 13 provided on the central portion of the working table 2 to confront each other apart by an interval conforming to the width W of the mask cloth M define a path for feeding therethrough the mask cloth M to be sewn together with a mask carrier plate 19 fixed to the central portion of the working table 2 as illustrated in FIG. 4. A throat plate 1*c* is incorporated into the central opening portion of the mask carrier plate 19 as illustrated in FIG. 3, and a pair of needle holes 1*d* for passing the needles ND of the sewing machines 1 and 1 therethrough respectively are formed in the throat plate 1*c*.

Figure 2:
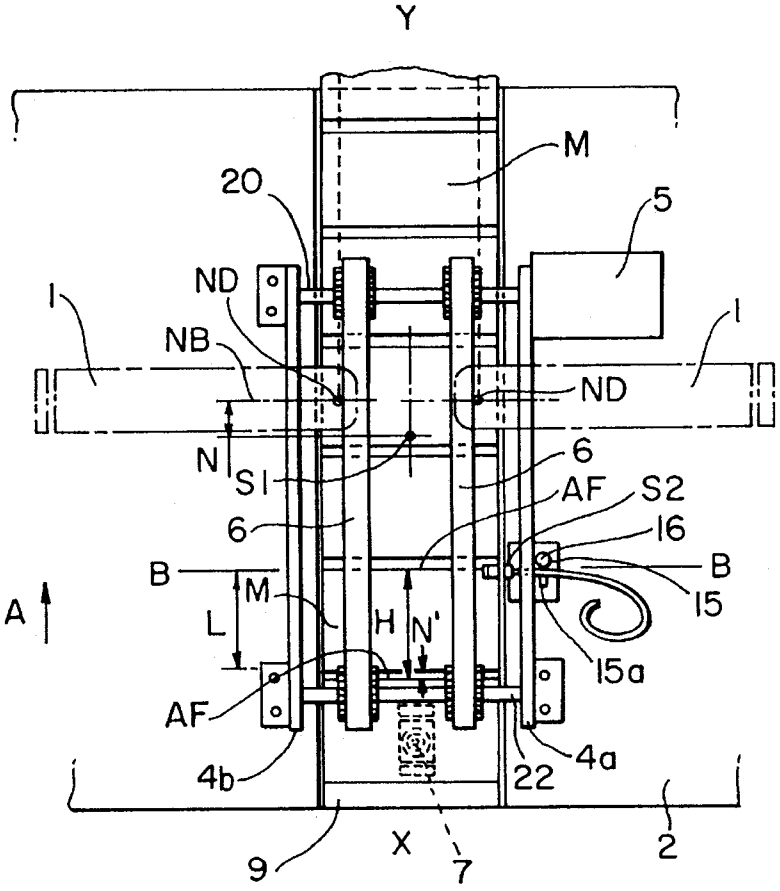
FIG. 2 is a plan view of the sewing device in FIG. 1.
Figure 1:
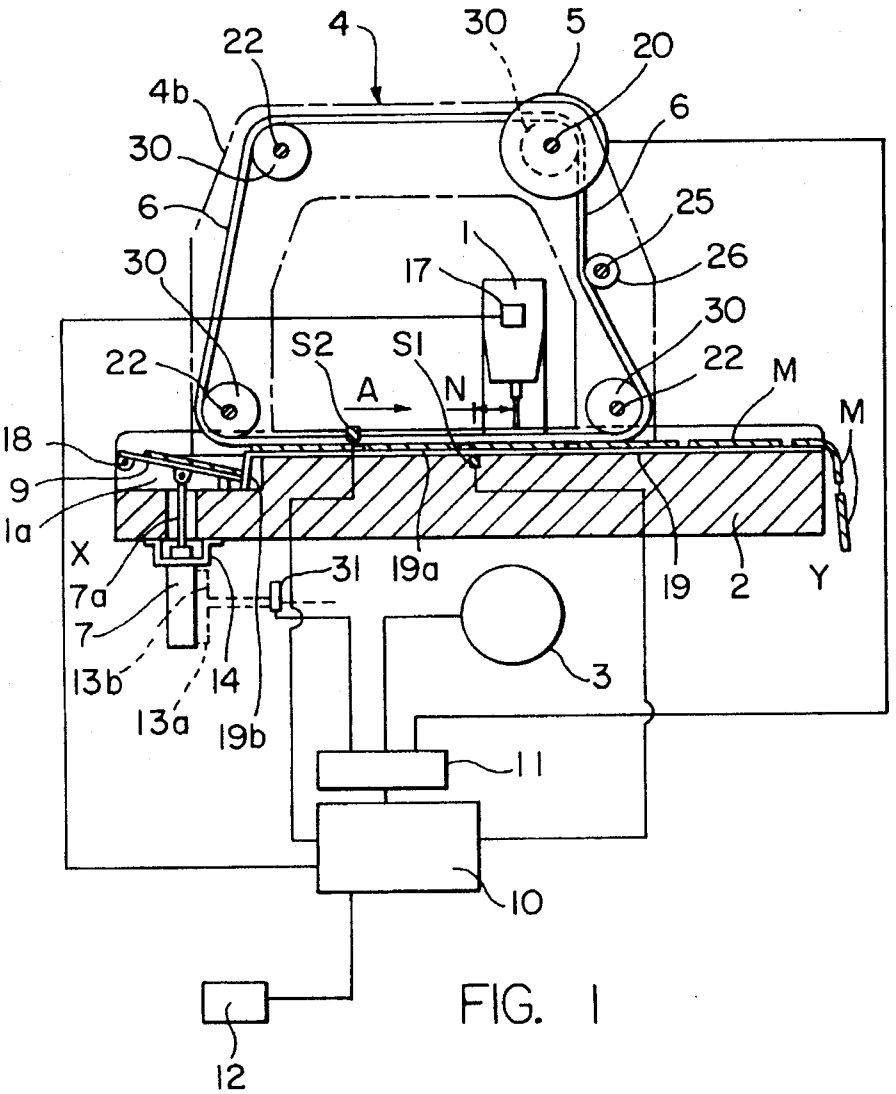
FIG. 1 is a side view showing a sewing device according to a first embodiment of the present invention partially in cross section.

Denoted at 4*a* and 4*b* are arched supporting members, which confront each other being mounted on the working table 2 astride the sewing machines 1 and 1 respectively to form the frame of the feeding unit 4 as illustrated in FIGS. 1 and 2. A driving shaft 20, three rotating shafts 22 and a supporting shaft 25 are supported between the supporting members 4*a* and 4*b* as illustrated in FIG. 1.

The driving shaft 20 disposed above the rear portion of the working table 2 is rotatably supported by the supporting members 4*a* and 4*b* and the rotating shaft of a pulse motor 5 serving as a feeding drive unit mounted on the side surface of a supporting member 4*a* is connected to the driving shaft 20. A pair of toothed pulleys 30 are fixed to the driving shaft 20 in bilateral symmetry.

The rotating shafts 22 and the driving shaft 20 arranged at the vertexes of a substantial rectangle are rotatably supported by the supporting members 4*a* and 4*b* and a pair of pulleys 30 are fixed to each of the rotating shafts 22. Two rotating shafts 22, one extending between the front lower portions of the supporting members 4*a* and 4*b* and the other extending between the rear lower portions thereof, are arranged on a horizontal plane. Since each of the pair of toothed endless conveyer belts 6 is wound around each rectangle composed of one of the pairs of the pulleys 30, the conveyer belts 6 are turned normally and reversely by driving the pulse motor 5 in the normal and reverse directions respectively. Since the supporting shaft 25 rotatably supports a single tension pulley 26, It is possible to apply a proper tension to the pair of conveyer belts 6 which are in contact with the tension pulley 26 by adjusting the mounting position of the supporting shaft 25. The supporting members 4*a* and 4*b*, the driving shaft 20, the rotating shafts 22, the pulleys 30, the pulse motor 5, etc. constitute the feeding unit 4 which drives the conveyer belts 6 in the normal and reverse directions.

The pair of conveyer belts 6 which are disposed in parallel to each other and to which tension is applied by the tension pulley 26, each conveyer belt 6 being wound around each of the pairs of the pulleys 30, are in a substantially horizontal plane apart from the feeding surface 19*a*, i.e., the upper surface of the mask carrier plate 19 by a given interval at the portions thereof between the pulleys 30 around two rotating shafts 22 disposed between the supporting members 4*a* and 4*b* at the front and rear lower end portions thereof. The horizontal portions of the conveyer belts 6 form the feeding side X at the rear sides thereof and the sending-out side Y at the front sides thereof as illustrated in FIG. 2. The conveyer belts 6 arranged above the feeding surface 19*a* of the working table 2 between the needles ND gradually feed the mask cloths M on the feeding surface 19*a* longitudinally from the feeding side X toward the sending-out side Y.

On the other hand, a cavity la is formed adjacent to the rear end portion of the mask carrier plate 19 in the working table 2 under the rear end portions of the conveyer belts 6 as illustrated in FIG. 1 and a stopper portion 19*b* which is formed by bending down the rear end portion of the mask carrier plate 19 hangs down in the front end portion of the cavity 1*a*. The stopper portion 19*b* has a function to regulate the position to which the mask cloth M placed on a sewn product supporting member 9, described later, is inserted. The stopper portion 19*b* has a shape of circular arc having a center at a supporting shaft 18, described later.

The sewn product supporting member 9 is disposed in the cavity 1*a*. The rear end portion of the sewn product supporting member 9 is swingably supported by the working table 2 by way of the supporting shaft 18. The sewn product supporting member 9 is equipped with a doubleacting-type pneumatic actuator 7 serving as a vertically driving unit for driving the sewn product supporting member 9 up and down between the height of the feeding surface 19*a*, i.e., the upper surface of the mask carrier plate 19 and that lower than the feeding surface 19*a*. The pneumatic actuator 7 is fixedly mounted on the lower surface of the working table 2 by way of the supporting member 14 and its piston rod 7*a* enters the cavity 1*a* to be connected to the lower portion of the sewn product supporting member 9 at the tip end thereof in such a way as to be relatively swingable to each other by way of a pin.

The pneumatic actuator 7 is operated forward by switching a changeover valve to supply compressed air to the lower chamber thereof through a compressed air supply route 13*a* from a compressed air source, not shown, and exhaust the upper chamber thereof, or is operated backward by switching the changeover valve to supply compressed air to the upper chamber thereof through the other compressed air supply route 13*b* and exhaust the lower chamber thereoff The forward operation of the pneumatic actuator 7 projects the piston rod 7*a* to swing upward the sewn product supporting member 9 about the supporting shaft 18 so as to conform in height the upper surface of the sewn product supporting member 9 to the feeding surface 19*a* of the mask carrier plate 19, and the backward operation of the pneumatic actuator 7 swings down the sewn product supporting member 9 so that the sewn product M can be placed on the sewn product supporting member 9 from the feeding side X.

Denoted at S1 is a cloth position sensor serving as a cloth position detecting means for detecting the front end portion AF of the sewn product M fed from the sewn product supporting member 9 by the conveyer belts 6 to supply the detection signal to a control unit 10 toward the feeding side X by a distance N, the cloth position sensor S1 being arranged apart from the needle position line NB connecting the central axes of a pair of needles ND which are disposed to confront each other on the throat plates 1*c* of the sewing machines 1 and 1. The distance N is set to be longer than the length of the back tack stitches BT of the mask cloth M. The cloth position sensor S1 incorporated into the throat plate 1*c* as illustrated in FIG. 3 can be composed of, e.g., a photosensor having a light-emitting element and a light-receiving element. The operation of the sewing machine motor 3 and pulse motor 5 are controlled based on a control signal issued by the cloth position sensor S1.

Figure 7:
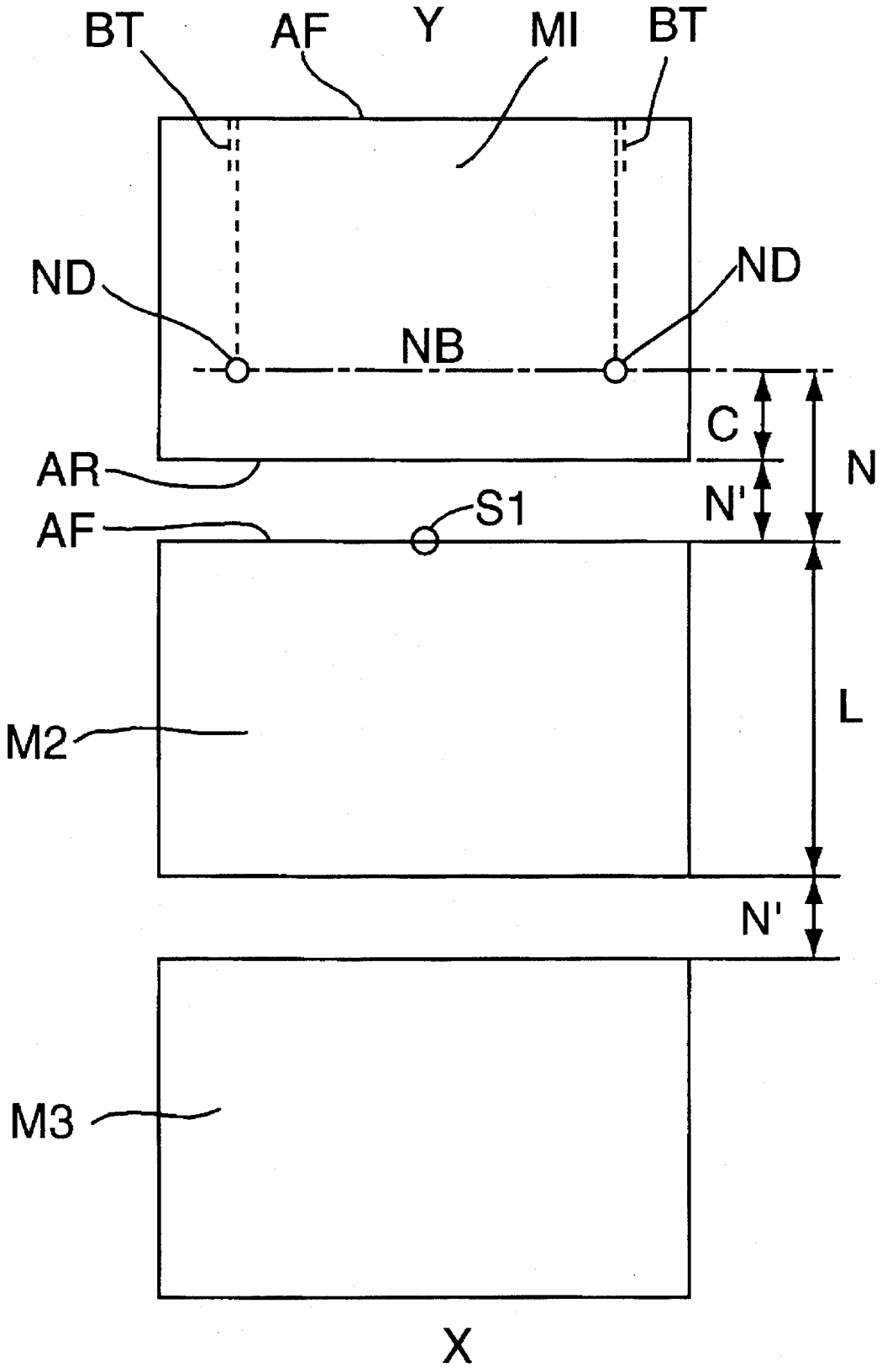
FIG. 7 is a view for explaining the function of the sewing device in FIG. 1.

The cloth position sensor S1 activates the pulse motor 5 to feed the first mask cloth M1 toward the sending-out side Y as far as the distance N when the front end portion AF of the first mask cloth M1 is detected, then activates the sewing machine motor 3 and pulse motor 5 to form the back tack stitches BT adjacent to the front end portion AF of the first mask cloth M1. The sensor S1 then activates the pulse motor 5 to feed the first mask cloth M1 toward the sending-out side Y by a difference C between the distance N and the interval N' and activates the sewing machine motor 3 when the front end portion AF of the following mask cloth M2 as illustrated in FIG. 7 and thereafter issues a control signal for activating the sewing machine motor 3 and pulse motor 5 to form back tack stitches BT adjacent to the rear end portion AR of the preceding mask cloth M1.

Denoted at S2 is a cloth end sensor serving as a cloth end detecting means, which is provided above the side end of the mask cloth M apart from the stopper portion 19*b* of the mask carrier plate 19, i.e., the front end portion AF of the mask cloth M placed on the sewn product supporting member 9 by a distance H, being positioned at the side of the feeding side X of the mask cloth M relative to the cloth position sensor S1 as illustrated in FIGS. 2 and 4. The cloth end detecting means S2 is fixed to the working table 2 by way of a sensor mounting plate 15. The sensor mounting plate 15 having a long hole 15*a* extending in the feeding direction (indicated by an arrow A) of the mask cloth M is fixedly mounted on the working table 2 by way of a fixing screw 16. The cloth end detecting means S2 is adjustable forward or backward in mounting position.

The cloth end detecting means S2 detects the front end portion AF of the mask cloth M fed from the sewn product supporting member 9 by the conveyer belts 6 to supply a detection signal to the control unit 10. When the control unit 10 receives the detection signal from the cloth end detecting means S2, it temporarily stops the pulse motor 5 of the feeding unit 4 by way of a driving circuit 11 and the sewing machine motor 3 in operation as well. That is, the pulse motor 5 starts operation upon completion of lifting of the sewn product supporting member 9 which carries the mask cloth M thereon and temporarily stops operation when the cloth end detecting means S2 detects the front end portion AF of the mask cloth M.

As described above, the mask cloth M conveyed by the conveyer belts 6 is stopped based on the detection signal issued by the cloth end detecting means S2 which is disposed apart from the front end portion AF of next mask cloth M by the distance H, and the following mask cloth M starts to be conveyed from a position having a given relationship with the position of the preceding mask cloth M which is at standstill. Accordingly, supposing that the length of the mask cloth M is L and the interval between the mask cloths M is N' (several millimeters), N'=H−L is established as illustrated in FIG. 2 so that it is possible to always keep constant the interval N' between the mask cloths M which are conveyed one after another.

Figure 9:
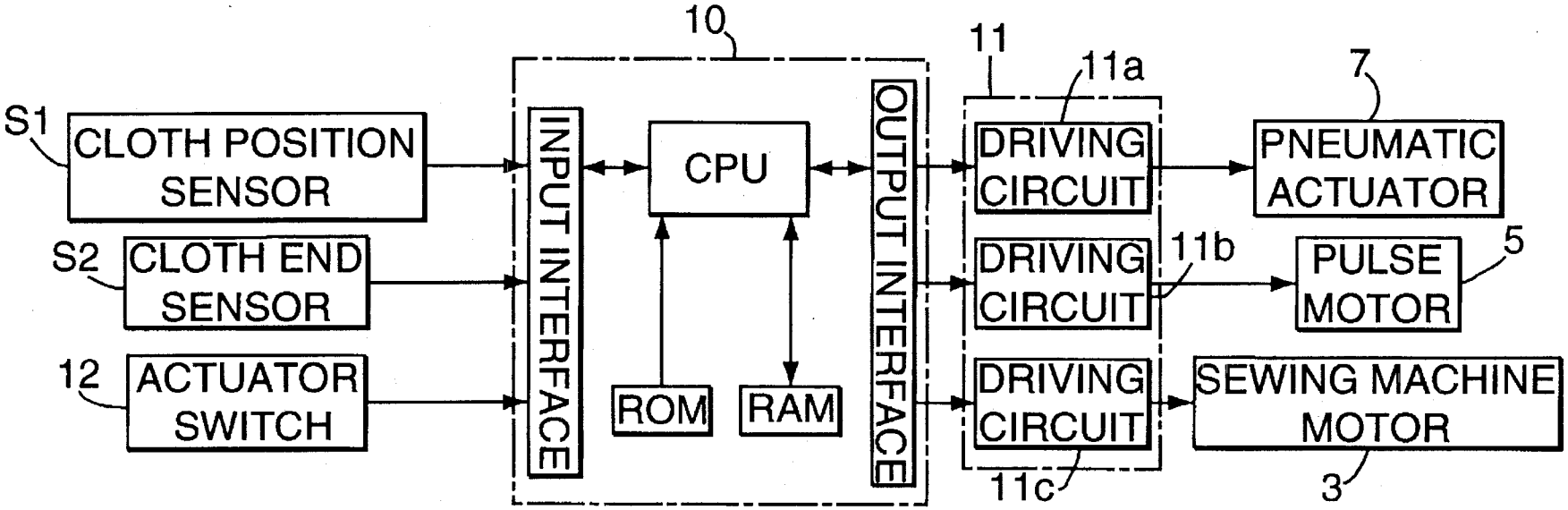
FIG. 9 is a block diagram showing the arrangement of electric units in the sewing device in FIG. 1.

The control unit 10 composed of a well-known microcomputer equipped with a CPU, i/o interfaces, ROM and RAM as illustrated in FIG. 9 performs sequence control in the operation of the sewing machine motor 3 of each of the sewing machines 1 and 1, the pulse motor 5 of the feeding unit 4 and the pneumatic actuator 7. That is, the control unit 10 is programmed to interlock the lifting of the sewn product supporting member 9 driven by the pneumatic actuator 7 actuated by way of an actuator switch 12, described later, with the rotation of the pulse motor 5 in the feeding unit 4, so that the pulse motor 5 starts rotation upon completion of lifting the sewn product supporting member 9 by the forward operation of the pneumatic actuator 7, i.e., when the sewn product supporting member 9 conforms in height to the feeding surface 19*a*.

The control unit 10 stores therein data for producing pulse signals necessary for advancing the mask cloth M as far as the distance N from the position of the cloth position detecting means S1 to the needle position line NB by way of the conveying belts 6 driven by the pulse motor 5. As described above, the driving circuit 11 rotates the pulse motor 5 by a given amount until the front end portion AF of the first mask cloth M1 reaches the needle position line NB, i.e., until the completion of the pulse signals, when the driving circuit 11 supplies a driving signal to the sewing machine motor 3 to start sewing and at the same time rotates the pulse motor 5 normally or reversely by a given amount to form the back tack stitches BT. The driving circuit 11 also calculates the difference C between the distance N and the interval N' as illustrated in FIG. 7 when the front end portion AF of the following mask cloth M2 is detected and drives the pulse motor 5 to feed the preceding mask cloth M1 toward the sending-out side Y by the difference C and drives the sewing machine motor 3 as well then issues a detection signal for driving the sewing machine motor 3 and pulse motor 5 to form the back tack stitches BT adjacent to the rear end portion AR of the preceding mask cloth M1.

As described above, the control unit 10 has a sewing data stored therein for forming several back tack stitches BT by forward and backward sewing at the start and end of sewing operation, and the driving circuit 11 controls the normal and reverse rotation of the pulse motor 5 and the rotation of the sewing machine motor 3 to form several stitches based on the sewing data. The driving circuit 11 having a function to control the sewing machine motor 3, pulse motor 5 and pneumatic actuator 7 based on an instruction signal from the control unit 10 is equipped with a driving circuit 11*a* for the pneumatic actuator 7, a driving circuit 11*b* for the pulse motor 5 which conveys the mask cloth M and a driving circuit 11*c* for the sewing machine motor 3.

Denoted at 12 is an actuator switch, which actuates the pneumatic actuator 7 when an operator operates the actuator switch 12 to thereby lift the sewn product supporting member 9 so that the mask cloth M is fed onto the lower surface of the conveying belts 6.

Figure 8:
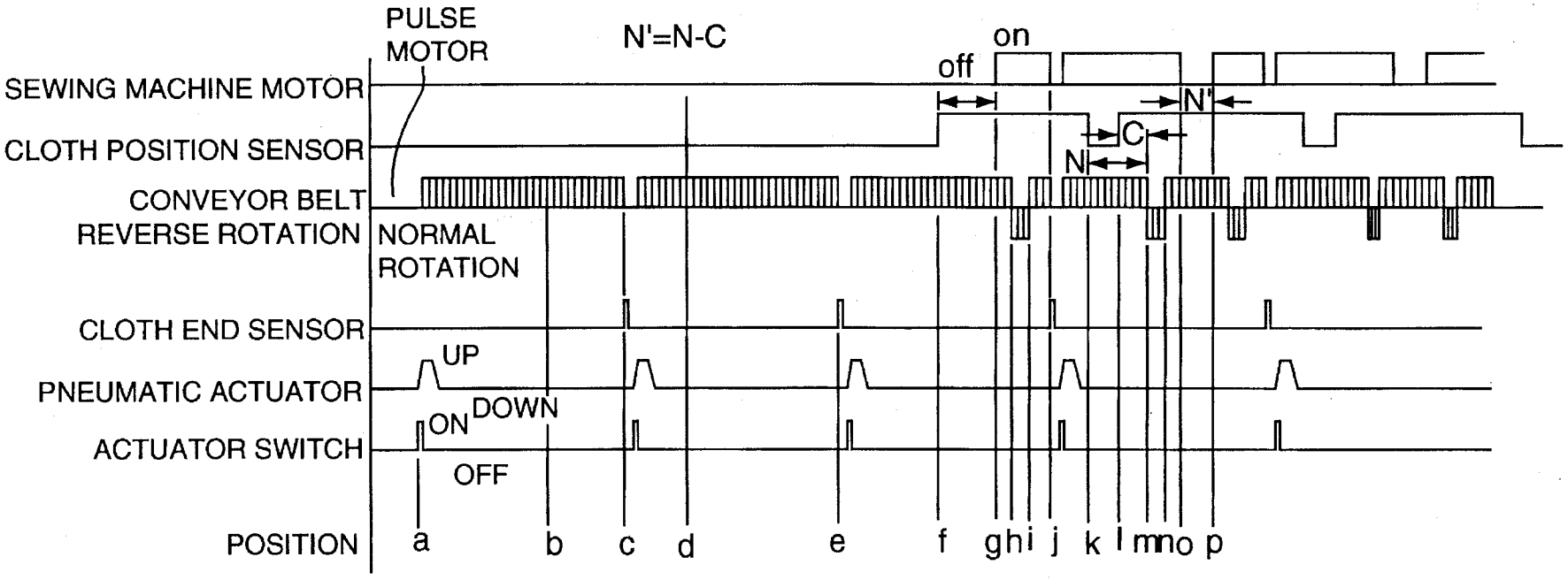
FIG. 8 is a diagram showing a timing chart of the sewing device in FIG. 1.

The operation of the above embodiment will be described with reference to FIGS. 5, 6 and timing charts in FIG. 8 and table 1. Symbols a to p in FIG. 8 and table I correspond to positions a to p respectively as illustrated in FIGS. 5 and 6. [Table 1]

Figure 5:
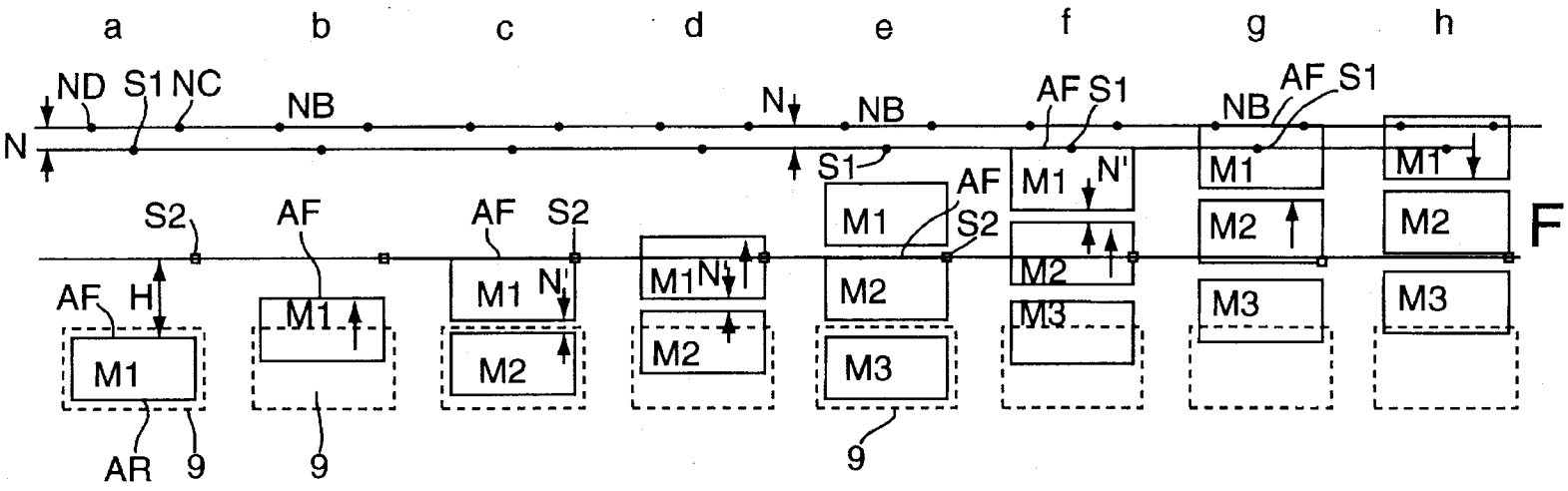
FIG. 5 is a view for explaining the function of the sewing device in FIG. 1.
Figure 6:
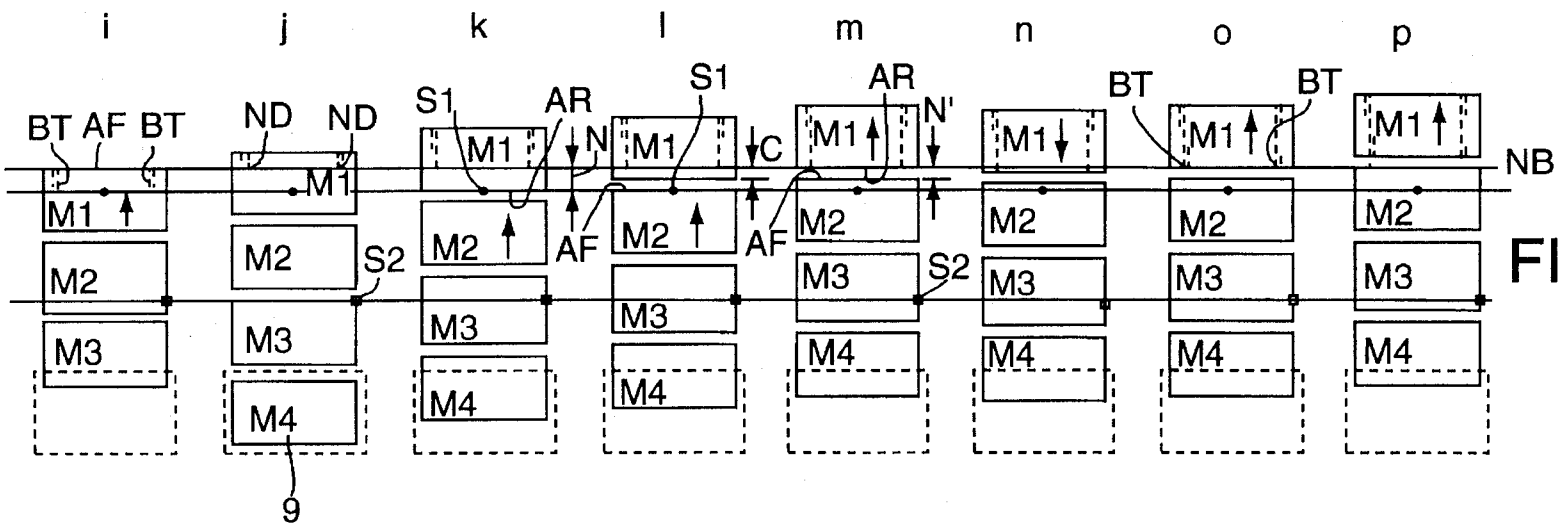
FIG. 6 is a view for explaining the function of the sewing device in FIG. 1.

At first, a first mask cloth M1 is placed on the sewn product supporting member 9 as illustrated in the left end position a in FIG. 5. At that time, the sewing machine motor 3 and the pulse motor 5 of the feeding unit 4 are at standstill, the actuator switch 12 is off and the pneumatic actuator 7 has been operated backward.

When the actuator switch 12 is turned on, the pneumatic actuator 7 is operated forward to lift the sewn product supporting member 9 from the lowered state. Upon completion of lifting of the sewn product supporting member 9, the pulse motor 5 of the feeding unit 4 starts operation as illustrated position h in FIG. 5 so that the first mask cloth M1 starts to be conveyed on the mask carrier plate 19 by the conveying belts 6 toward the sending-out side Y. After the first mask cloth M1 starts to be conveyed, the pneumatic actuator 7 is properly operated backward to lower the sewn product supporting member 9. When the first mask cloth M1 is fed and the cloth end detecting means S2 detects the front end portion AF of the first mask cloth M1 as illustrated in position c in FIG. 5, a detection signal is supplied to the control unit 10 by way of the driving circuit 11*b* of the pulse motor 5 to stop the pulse motor 5 and consequently the conveyer belts 6.

At that time, the cloth end detecting means S2 is positioned apart from the front end portion AF of the mask cloth M on the sewn product supporting member 9 by the distance H and the sum of the length L of the mask cloth M and the interval N' between the first and second mask cloths M1 and M2 is equal to the distance H, so that the interval N' is also constant. During the feeding of the first mask cloth M1, the second mask cloth M2 is placed on the lowered sewn product supporting member 9 since the space above the same is evacuated as the first mask cloth M1 has been conveyed therefrom as illustrated at position c in FIG. 5.

Then the actuator switch 12 is turned on to lift the sewn product supporting member 9 which carries the second mask cloth M2 thereon from the lowered state. Upon completion of lifting of the sewn product supporting member 9, the pulse motor 5 of the feeding unit 4 starts operation to start feeding the second mask cloth M2 as illustrated at position d in FIG. 5. The second mask cloth M2 is continuously fed together with the first mask cloth M1 until the front end portion AF of the second mask cloth M2 is detected by the cloth end detecting means S2. When the cloth end detecting means S2 detects the front end portion AF of the second mask cloth M2, the pulse motor 5 of the feeding unit 4 stops.

During the above operation, the pneumatic actuator 7 is operated backward to lower the sewn product supporting member 9 to its standby position, so that a third mask cloth M3 is placed on the sewn product supporting member 9 as illustrated at position e in FIG. 5.

When the actuator switch 12 is turned on again, the sewn product supporting member 9 which carries the third mask cloth M3 thereon is lifted. The pulse motor 5 starts rotation to start feeding the third mask cloth M3 together with the first and second mask cloths M1 and M2 as illustrated at position f in FIG. 5 and then the front end portion AF of the first mask cloth M1 is detected by the cloth position detecting means S1. When the cloth position detecting means S1 supplies a control signal to the control unit 10, the driving circuit 11*b* of the pulse motor 5 supplies a signal to the pulse motor 5 to drive the same by a given number of pulses based on a sewing data previously stored in the control unit 10 so that the first mask cloth M1 is fed until the front end portion AF of the first mask cloth M1 reaches the needle position line NB as illustrated at position g in FIG. 5. During the operation, the pneumatic actuator 7 operates backward to lower the sewn product supporting member 9 to its standby position.

When the front end portion AF of the first mask cloth M1 reaches the needle position line NB, i.e., upon completion of rotation of the pulse motor 5 by a given number of pulses, sewing data previously stored in the control unit 10 is issued from the driving circuit 11*c* of the sewing machine motor 3 to rotate the sewing machine motor 3 based thereon to form a given number of stitches on the first mask cloth M1 as illustrated at position h in FIG. 5. At that time, the pulse motor 5 is driven to rotate reversely after the same is normally driven to rotate by a given number of pulses previously stored in a memory circuit in the control unit 10 so as to drive the conveying belts 6 forward and backward. As the sewing machine motor 3 is driven to rotate and the conveying belts 6 are driven in this way, back tack stitches BT are formed adjacent to the front end portion AF of the first mask cloth M1 by way of forward and backward sewing for a given length. In practice, the sewing machine motor 3 is driven to rotate while needle position detectors, not shown, detect the vertical positions of the needles ND.

After back tack stitches BT of a given length have been formed as illustrated at position i in FIG. 6, the pulse motor 5 of the feeding unit 4 and the sewing machine motor 3 are controlled to continue forward sewing until the front end portion AF of the third mask cloth M3 is detected by the cloth end detecting means S2 as illustrated at position a in FIG. 6. When the front end portion AF of the third mask cloth M3 is detected by the cloth end detecting means S2, the pulse motor 5 of the feeding unit 4 and the sewing machine motor 3 are stopped. During the operation, a fourth mask cloth M4 is placed on the sewn product supporting member 9 as illustrated at position i in FIG. 6.

When the actuator switch 12 is turned on, the sewn product supporting member 9 which carries the fourth mask cloth M4 thereon is lifted. Subsequently the fourth mask cloth M4 starts to be conveyed and at the same time the sewing machine motor 3 starts rotation to resume sewing the first mask cloth M1 as illustrated at position k in FIG. 6. Sewing the first mask cloth M1 continues until the rear end portion AR of the first mask cloth M1 is detected by the cloth position detecting means S1 and a control signal is supplied to the control unit 10. During the operation, the pneumatic actuator 7 is operated backward to lower the sewn product supporting member 9 to its standby position.

After the rear end portion AR of the first mask cloth M1 is detected by the cloth position detecting means S1, sewing continues until the front end portion AF of the second mask cloth M2 is detected by the cloth position detecting means S1 as illustrated at position l in FIG. 6. When the front end portion AF of the second mask cloth M2 is detected by the cloth position detecting means S1, the distance C between the rear end portion AR of the first mask cloth M1 and the needle position line NB, i.e., the length remaining to be sewn is calculated to be stored in the memory circuit in the control unit 10 based on the equation C=N−N', wherein N' is the interval between the first and second mask cloths M1 and M2 and N is the distance between the cloth position detecting means S1 and the needle position line NB.

When the front end portion AF of the second mask cloth M2 is detected by the cloth position detecting means S1, the pulse motor 5 of the feeding unit 4 and the sewing machine motor 3 are driven to rotate by the number of pulses based on the sewing data previously stored in the control unit 10, so that a given number of stitches are formed over a distance corresponding to the distance C until the rear end portion AR of the first mask cloth M1 reaches the needle position line NB as illustrated in m in FIG. 6. As illustrated in FIG. 7, the sum of the distance C between the rear end portion AR of the first mask cloth M 1 and the needle position line NB and the interval N' between the adjacent mask cloths M1 and M2 is equal to the distance N between the cloth position detecting means S1 and the needle position line NB and the distance C is constant. Accordingly, it is possible to perform sewing as far as the distance corresponding to the distance C by rotating the pulse motor 5 of the feeding unit 4 and the sewing machine motor 3 by the number of pulses based on the sewing data previously stored in the control unit 10 after the front end portion AF of the second mask cloth M2 is detected by the cloth position detecting means S1. In this way, the stitch lines FT to stitch the folded end portions Ma and Mb of the first mask cloth M1 together are formed.

When the rear end portion AR of the first mask cloth M1 reaches the needle position line NB in this way, the sewing machine motor 3 and pulse motor 5 are driven to rotate normally and reversely by a given number of pulses based on the sewing data previously stored in the control unit 10 as illustrated in positions n to o in FIG. 6. As a result, back tack stitches BT are formed adjacent to the rear end portion AR of the first mask cloth M1 by backward and forward sewing as far as a given length.

After the back tack stitches BT of a given length are formed, that is, when the rear end portion AR of the first mask cloth M1 reaches the needle position line NB as illustrated at position o in FIG. 6, the sewing machine motor 3 alone is stopped and the mask-cloths M are successively fed by the rotation of the pulse motor 5. The mask cloths M are fed until the front end portion AF of the second mask cloth M2 reaches the needle position line NB, the distance of feeding being equal to the interval N' between the adjacent mask cloths M1 and M2.

Thereafter, similarly to that illustrated at position h in FIG. 5, the sewing machine motor 3 is driven to rotate based on the given data previously stored in the memory circuit of the control unit 10 and the pulse motor 5 is driven to rotate normally and reversely by a given number of pulses previously stored in the memory circuit of the control unit 10 to drive the conveying belts 6 forward and backward so as to form back tack stitches BT adjacent to the front end portion AF of the second mask cloth M2 by sewing forward and backward for a given length. In this way, by repeating the operations illustrated at positions g in FIG. 5 to p in FIG. 6, the second and later mask cloths M are successively sewn to make a plurality of mask cloths M connected in a chain apart from one another by a given interval N'. The rear end portion AR of a preceding mask cloth M1 and the front end portion AF of a following mask cloth M2 are connected to each other by sewing threads since sewing is suspended in the interval N' (=N−C) between the mask cloths M as illustrated at position p in FIGS. 6 and 7.

Figure 11:
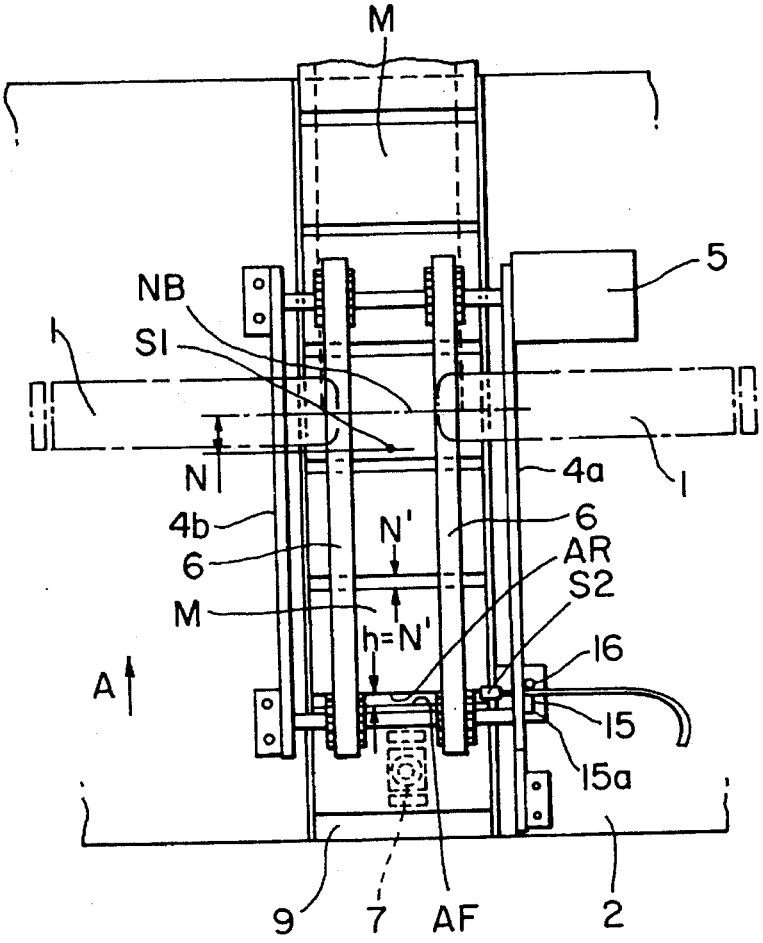
FIG. 11 is a plan view showing the other arrangement of the cloth end sensor in the sewing device in FIG. 1.

Although the cloth end detecting means S2 is arranged to detect the front end portion AF of the mask cloth M in the above embodiment, it is also possible to arrange the cloth end detecting means S2 to detect the rear end portion AR of the mask cloth M to secure a given interval N' between adjacent mask cloths M. At that time, however, the distance h between the front end portion AF of the mask cloth M placed on the sewn product supporting member 9 and the cloth end detecting means S2 is set to be equal to the interval N' between adjacent mask cloths M as illustrated in FIG. 11.

As understood from the above description, the sewing device according to the present invention can efficiently sew a sewn product of high quality having stitch lines on both sides thereof which are uniform and symmetrical to each other and can regulate the position to which the sewn product is fed from a sewn product supporting member by a cloth end detection means to constantly keep a proper interval between next sewn product and itself.

As a result, it is possible to properly set the length of the connecting portions of the sewn products which are subjected to continuous sewing so that the sewn products may be cut off from one another by one cutting operation of an operator so as to be remarkably effective in rationalization of cut-off operation of sewn products in a sewing factory. Moreover, it produces additional effects of preventing cut-off threads from being scattered in work place and also economizing the threads. Moreover, shortening the connecting portions of the sewn products within the range in which the sewn products are not damaged restrains the generation of defective products.

Furthermore, providing the cloth position detection means facilitates the operation of forming back tack stitches adjacent to the front or back end portions of the sewn products.

TABLE 1

| | actuator | pneumatic actuator | | conveyer pulse mode | | sewing machine motor | | |
|---|---|---|---|---|---|---|---|---|
| position | switch | down | up | stop | drive | stop | drive | note |
| a | ON | *→ | | * | | * | | |
| b OFF | | ←* | | * | * | | | |
| c | ON | *→ | | * | | * | | front end of 1st cloth end detected |
| d | OFF | | ←* | | * | * | | |
| e | ON | *→ | | * | | * | | front end of 2nd cloth position detected |
| f | OFF | | ←* | | * | * | | 1st cloth position front end detected |
| g | " | * | | | * | | * | start of sewing 1st cloth |
| h | " | * | | | * | | * | |
| i | " | * | | | * | | * | |
| J | ON | *→ | | * | | * | | front end of 3rd cloth end detected |
| k | OFF | | ←* | | * | | * | rear end of 1st cloth position detected |
| l | " | * | | | * | | * | front end of 2nd cloth position detected |
| m | " | * | | | * | | * | |
| n | " | * | | | * | | * | |
| o | " | * | | | * | | * | completion of sewing 1st cloth |
| p | " | * | | | * | | * | start of sewing 2nd cloth |

What is claimed is:

1. A sewing device comprising:

a pair of synchronously operated sewing machines fixed on a working table to confront each other;

conveyer belts disposed above a feeding surface for feeding a sewn product on said feeding surface forward and backward from a feeding side to a sending-out side thereof;

a feeding drive unit for driving said conveyer belts normally and reversely;

a sewn product supporting member disposed under said conveyer belts at the feeding side of said sewn product for placing the same thereon;

a driving unit for driving said sewn product supporting member up and down between the height of said feeding surface and below said feeding surface;

a cloth end detecting means provided between a needle position line of said sewing machines and said sewn product supporting member for detecting either of a front end portion or a rear end portion of said sewn product, when a given interval is formed between said sewn product fed by said conveyer belts and a following sewn product which is placed on said sewn product supporting member, wherein said feeding drive unit starts operation upon completion of lifting of said sewn product supporting member which carries said sewn product thereon and stops operation when said cloth end detecting means detects either of the front end portion or rear end portion of said sewn product;

a cloth position detecting means provided between said needle position line of said sewing machines and said cloth end detecting means and spaced from said needle position line a given distance for activating said feeding drive unit to feed said first sewn product the given distance to the sending-out side when the front end portion of said first sewn product is detected and then activating said sewing machines and said feeding drive unit so as to form back stitches adjacent to the front end portion of said sewn product.

2. A sewing device according to claim 1, characterized in that said cloth position detecting means activates said driving feed unit to feed said sewn product as far as a difference between the given distance and the given interval toward the sending-out side and said sewing machines as well when the cloth position detecting means detects the front end portion of a following sewn product and then issues a control signal for activating said sewing machines and said driving feed unit so as to form back tack stitches adjacent to the rear end portion of said sewn product.

* * * * *